US007022954B2

(12) United States Patent
Behnke et al.

(10) Patent No.: US 7,022,954 B2
(45) Date of Patent: Apr. 4, 2006

(54) MICROWAVE CAVITY RESONATOR FOR HEATING PRINTING SUBSTANCE AND/OR TONER

(75) Inventors: Knut Behnke, Kiel (DE); Frank-Michael Morgenweck, Molfsee (DE); Domingo Rohde, Kiel (DE); Lars Seimetz, Achterwehr (DE); José Manuel Catalá-Civera, Valencia (ES)

(73) Assignee: Eastman Kodak Company, Rochester, NY (US)

( * ) Notice: Subject to any disclaimer, the term of this patent is extended or adjusted under 35 U.S.C. 154(b) by 198 days.

(21) Appl. No.: 10/664,510

(22) Filed: Sep. 17, 2003

(65) Prior Publication Data

US 2004/0226942 A1 Nov. 18, 2004

(30) Foreign Application Priority Data

Oct. 14, 2002 (DE) ..... 102 47 798
Jul. 31, 2003 (DE) ..... 103 35 024

(51) Int. Cl.
*H05B 6/70* (2006.01)
*H05B 6/78* (2006.01)

(52) U.S. Cl. ..... 219/693; 219/690; 219/696; 219/697; 219/746; 219/750; 399/329; 399/336; 347/102; 34/259

(58) Field of Classification Search ..... 219/690–697, 219/746–750, 756; 399/328–338; 34/259, 34/264; 347/102
See application file for complete search history.

(56) References Cited

U.S. PATENT DOCUMENTS 3,783,221 A * 1/1974 Soulier ..... 219/693
3,851,131 A 11/1974 Johnston et al.
3,999,026 A 12/1976 Böling
4,625,088 A 11/1986 Gics
2003/0154620 A1* 8/2003 Lyle et al. ..... 34/245

* cited by examiner

*Primary Examiner*—Philip H. Leung
(74) *Attorney, Agent, or Firm*—Lawrance P. Kessler

(57) ABSTRACT

Heating a printing substance and/or toner, in an electrophotographic printer, with a standing microwave formed by at least one cavity resonator, with the printed matter being caused to move through the resonator gap. The power distribution of the microwave applied by the resonator is shaped and configured for specific application requirements.

17 Claims, 8 Drawing Sheets

MICROWAVE CAVITY RESONATOR FOR HEATING PRINTING SUBSTANCE AND/OR TONER

FIELD OF THE INVENTION

The invention relates to heating a printing substance and/or toner, more specifically, in an electrophotographic printer, with at least one standing wave produced by at least one cavity resonator with at least one cavity for microwaves from a transmitter, a microwave source, or microwave generator, with the printed matter being caused to move through the resonator gap.

BACKGROUND OF THE INVENTION

A process and apparatus for microwave fusing are disclosed in U.S. 2003013034. Resonators that are arranged at right angles to the plane of the printed matter for fixing the toner are used, which overlap each other's effective widths in an appropriate set over the width of the printed matter. Accordingly, this width, which extends transversally to the transport direction of the printed matter, can be covered with the treatment fully without gaps. As shown more specifically in FIG. 3, the intensity of the electric field $E_x$, which is applied in parallel to the width direction of the printed matter, should be trapezoidal and almost rectangular. This can be seen in the resonator power distribution in the x direction.

It is possible in principle to find a resonator with a desirable or almost desirable power distribution profile. Regarding the trapezium profile, the side steepness of the actual field intensity distribution or power distribution for the real resonators depends on the required overlap of the adjacent resonators. The overlap area presents the risk that depending on the side steepness and overlap width, toner strips that are within the overlap area will be heated too much or too little. The ideal would be to have a precisely rectangular field profile, with an infinitely high-side steepness, so that no overlap is required. It is, however, very hard from the technical standpoint to implement this field profile. Further, inaccuracy of the printed matter transport also adds to the problem. If the transport and guidance direction of the printed matter is not exactly parallel with the longitudinal edge of the resonators, areas of the printed matter will not be heated, or they will be heated only a little when the overlap area is small. This may result in the problem of non-uniform heating and impairs the fixing results.

With inaccurate printed matter transport, the flatter sides can even be to advantage. The uniformity of heating over the width of the printed matter in this case will be better because of the gradual nature and overlapping of the effective area of a plurality of resonators working together, making the performance non-sensitive to the transport accuracy.

Further, a cooling device is located in the zone of the resonators, which cools down the printed matter in such a manner that the toner temperature is below its glass transition temperature. The cooling device can have an undesired effect on heating of the toner within the overlapping area of the resonators. If, for example, the cooling air is blown in the overlap area, and the printed matter in this area is cooled strongly, the fixing results in this area change. Also with regard to this, the overlap area can be of a profile insensitive to influence by shaping the side field intensity steepness of the resonators.

The disadvantage with the flatter side profile is that the overlap area should be made wider, with more resonators or wider resonators, (also referred to as applicators), in order to fix the toner over the entire width of the printed matter. It is, therefore, required in the state of the art that the profile of the resonator power profile be chosen in such a manner, for example, as to have the overlap as small as possible on the one hand, and on the other hand, to assure high process stability.

SUMMARY OF THE INVENTION

The above-described problems are solved according to the invention by each power distribution of microwave that is applied by each individual resonator being formed or configured individually for a specific application.

According to the invention, the power profile is preferably individually provided for the chosen resonator and for specific requirements. With a possibility of such shaping, a greater independence from the remaining arbitrariness in choosing a resonator is achieved, especially given the possibility, according to the invention, of assuring a certain degree of standardization of resonators of a set of resonators for a fixing device. It is not necessary to have a large variety of resonators with special different power profile characteristics and to choose a special resonator from this large variety of resonators.

Besides, the power profile can be reduced to characteristic areas and parametrically defined in a certain way. These areas or parameters, preferably predetermined of the resonator, are used in the development and implementation of the resonators according to the invention, for influencing the power profile.

The power profile according to the invention as a function of position is preferably adjusted or changed, more specifically and preferably over the width transversally with respect to the printed matter transport direction. The power distribution as a function of position can be divided into three essential areas. Out of the three different areas, two areas are characterized by a constantly almost linearly changing profile (sides), extending from the walls to the middle, between which there is the third area having a power profile, which in general can be described as a curve. The curvature of the curve can be positive, negative, or very small. This curve will be referred to below as a trapezium. Preferably provisions can be made for adjusting or changing the steepness of the sides of this U-shaped profile.

Alternatively or in addition, power distribution as a function of position can be substantially in the form of a trapezium, and the curvature of the middle base area is adjusted or changed. In an ideal case, as explained above, it would be desirable that the power distribution profile can be given substantially a rectangular form.

It can be appropriate and reasonable, based on certain process considerations, to assure that the power distribution as a function of position be made asymmetric. This can be used preferably for assuring homogeneous heating in the first place and to improve the joint operation of the resonators as compared to the simple flat side pattern of the field intensity profile.

In some cases it is, therefore, possible and reasonable to have a power profile that could be dynamically variable in time, eventually in accordance with the process performance in order to meet the current requirements. This is especially possible if, according to the invention, an appropriate adjustment of the profile of each power distribution is made in a measured manner using relatively few parameters of the power profile and respective resonators.

More specifically, a further embodiment of the method according to the invention resides in the fact that at least one geometric parameter of the resonator is adjusted or changed, at least relative to at least one other geometric parameter of the resonator. A resonator according to the invention is also preferably defined in terms of its geometrical parameters in order to provide the appropriate geometrical conditions according to the invention and to influence the power profile of the profile areas.

A simple embodiment according to the invention is to change the width of the resonator and the vertical clearance through which the printed matter is caused to move in order to change and adjust the side steepness of the power profile. An apparatus according to the invention is provided, based on the independent solution according to which a resonator is provided and configured for a predetermined power distribution of the microwave applied by the resonator in order to meet specific requirements.

This also applies to a further preferred embodiment of an apparatus according to the invention, which is distinguished by the fact that the power distribution as a function of position is adjusted or changed. Preferably, the power distribution is preset or changed over the width in the direction transverse with respect to the direction of printed matter movement. The power distribution, as a function of position, as described above, is substantially in the form of a trapezium, and the steepness of the sides in this distribution profile is preset or changed, and/or the power distribution is substantially in the form of a trapezium, and the curvature of the middle base area of this profile can be preset or changed. Here, for an ideal case, it is preferred that the power distribution profile be substantially preset or changed to have an almost rectangular shape.

With respect to the apparatus according to the invention, as an alternative, the power distribution as a function of position can be preset or changed to be asymmetrical, and/or the power distribution can be varied in time, or dynamically.

In another embodiment of an apparatus according to the invention, at least one geometric parameter of the resonator can be preset or changed at least relative to at least another geometrical parameter of the resonator in order to change or adjust the power distribution profile of the resonator in a desired manner and to a desired extent. In a simple case, it can be done by presetting or changing the gap width of the resonator. However, according to the invention, the accurate adjustment of the power distribution profile is achieved by a complex geometry or architecture of the resonator cavity and their ability to be changed.

Another embodiment or a resonator according to the invention is distinguished by the fact that the end face of the resonator that is remote from the microwave entry side is closed with a cavity cover. The cavity cover has a recess extending in the direction parallel with the printed matter transport direction, the recess preferably being shaped as a groove in the cover, extending from one cavity wall to the other. According to the invention, the depth of the recess is preferably preset or adjustable, and/or the width of the border or a plurality of borders of the recess is preset or adjustable transversally with respect to the printed matter transport direction. By adjusting these geometrical lengths in the area of the resonator cover, the curvature of the middle base area of a substantially trapezoidal power distribution profile is influenced and adjusted.

A further embodiment of the invention is distinguished by the fact that the cavity area located on the opposite side from the gap as seen from the microwave entry has at least one flange protruding inwardly into the cavity as a portion or a limiting surface for the gap, and/or located on the gap side as seen from the microwave entry has at least one flange protruding inwardly into the cavity as a portion or a limiting surface for the gap. These protruding flanges can be preferably made in such a manner that the flange forms only limiting surfaces which extend in parallel with the printed matter transport direction. By adjusting these linear dimensions, more specifically, by providing for presetting or adjustment preferably of the width of the flange or plurality of flanges transversally with respect to the transport direction of the printed matter so that all widths of the flanges can be preferably uniformly adjusted, the side steepness of the power distribution profile can be influenced and predetermined.

As an alternative, or in combination, a further embodiment of the invention is possible, which is distinguished by the fact that the cavity area located on the gap side in the cavity as seen from the microwaves entry has at least one partition wall portion, partly dividing the cavity, which runs in parallel with the transport direction of the printed matter. The partition wall portion has at least one shutter extending across the gap (or at least one protruding shelf that functions as a stop for a shutter), preferably at least on one side of the partition wall portion oriented in parallel with the transport direction of the printed matter through the gap. The distance from the edge of the partition wall portion facing the gap is preferably preset or adjustable in order to obtain a predetermined curvature of the power distribution profile of the resonator.

In another embodiment of the invention, if the part of the resonator remote from the microwave source is divided into at least two cavity areas by at least one partition wall portion, a separate microwave source can be connected to each cavity area, or a common microwave source can be connected to the cavity areas, which can be used for supplying the cavity areas through a power splitter. The common microwave source with the power splitter, which supplies the cavity areas by splitting the microwave source power output, represents a more reliable solution because both cavity areas are supplied exactly at the same microwave frequency. This is important, e.g., with wide T-101 resonator, which is preferably used as the applicator according to the invention.

BRIEF DESCRIPTION OF THE DRAWINGS

The invention will be now described with reference to the accompanying drawings illustrating embodiments of resonators according to the invention, and although modifications and embodiments other than those illustrated are possible, the invention is not limited to what is shown and described with reference to the accompanying drawings, in which.

DETAILED DESCRIPTION OF THE INVENTION

Figure 1:
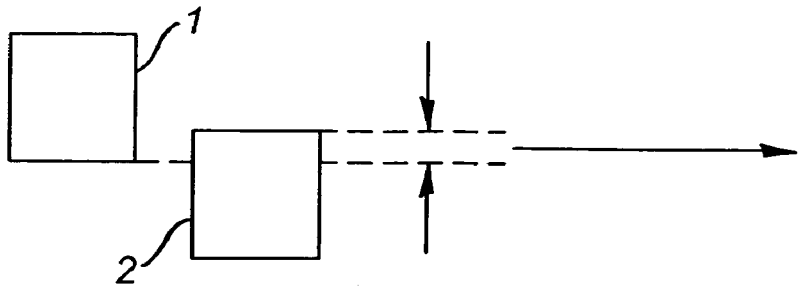
FIG. 1 (PRIOR ART)
FIG. 1 is a schematic view of two exemplary resonators installed one behind the other in the transport direction in a know per se manner.

FIG. 1 is a schematic view of two exemplary resonators 1 and 2 installed one behind the other in the transport direction in a known per se manner. This simple illustration is intended only for the purpose of showing how the printed matter whose transport direction through the resonators is shown with a long arrow is treated by the resonators mounted in series in this manner with an overlap.

Figure 2:
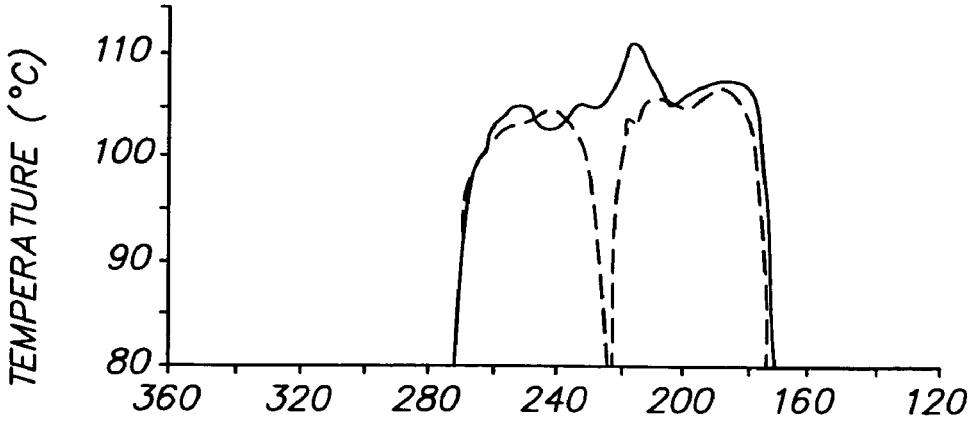
FIG. 2 (PRIOR ART)
FIG. 2 is an exemplary temperature profile obtained with the two resonators of FIG. 1 in a known per se manner.

FIG. 2 shows a temperature profile as measured at pointed in the transverse direction with respect to the printed matter transport direction. The temperature profile that was obtained only for the resonator 1 is shown with a dotted line, and the temperature profile obtained only from resonator 2 is shown with a dash-and-dot line, and the profile obtained from both resonators 1 and 2 together is shown with a solid line. The actual overlap of the temperature profiles of both resonators 1 and 2 is not shown in the scale of FIG. 1 because the temperature profile starts below the chosen position of the origin of coordinates (shown at a temperature value of about 80° C. instead of the origin at 0° C.), more specifically, at about 55° C. That is to say, FIG. 1 also shows only the peaks of the temperature profile. It can be seen that no horizontal temperature profile portion can be obtained in the overlap area of the resonators 1 and 2, and only temperature peaks are shown. The adding of the two profiles results in about 112° C. at the peak, i.e., two times the temperature value at the intersection point of the individual profiles, rather than about 105° C., which is the peak point of the individual profile. The printed matter will be exposed to the higher temperature at this point.

According to the invention, it is possible to optimize the temperature profile setting. It is especially desirable to influence the profile of the electric field transversally of the printing matter transport direction.

Figure 3A:
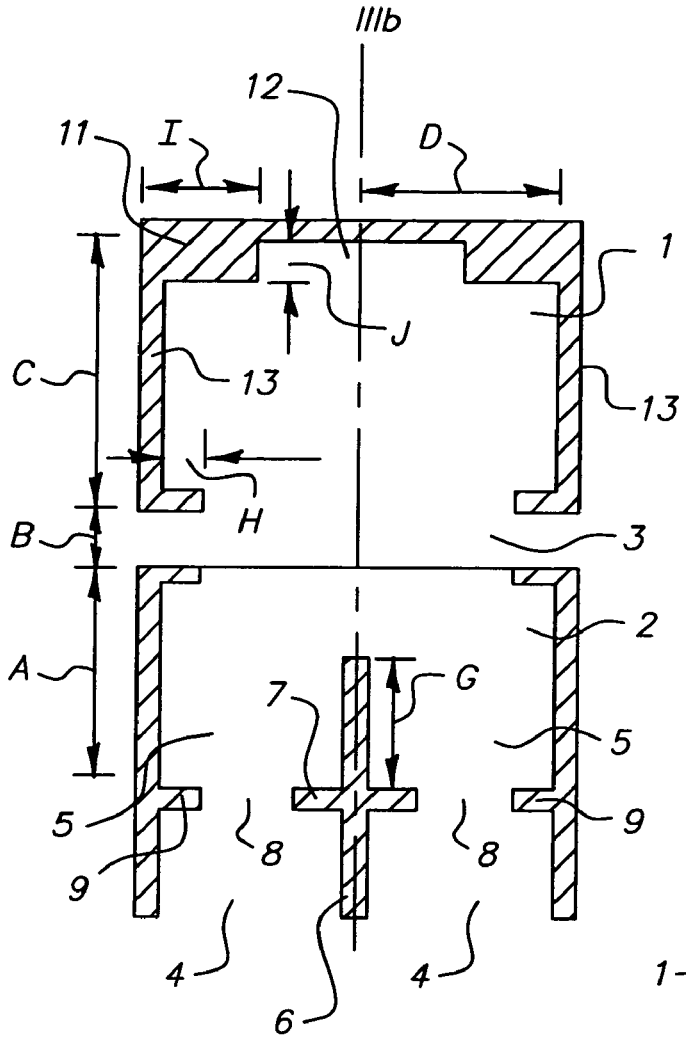
FIG. 3*a* is a sectional view of a resonator according to the invention taken transversally with respect to the transport direction of the printed matter as seen in the transport direction.
Figure 3B:
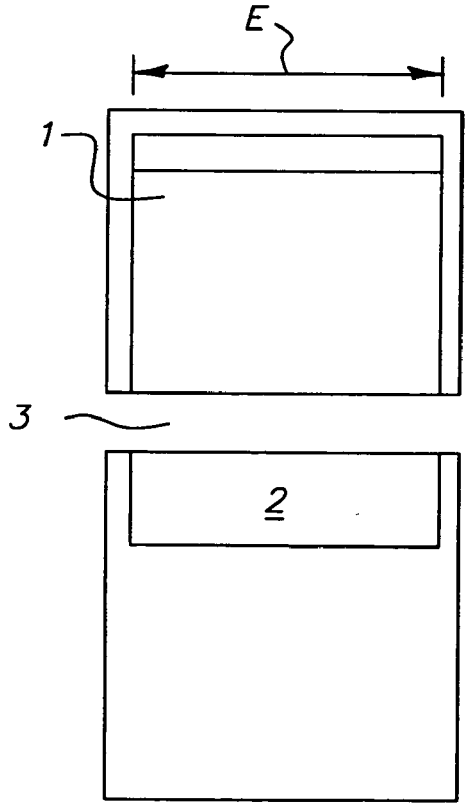
FIG. 3*b* is a sectional view of the resonator of FIG. 3*a* taken transversally of the section plane 111*b* in FIG. 3*a;*

TE-101 applicator is proposed as a resonator for an embodiment of the invention as shown in FIGS. 3*a* and 3*b*. More, specifically, FIG. 3*a* shows a sectional view as seen in the printed matter transport direction and in a sectional view in FIG. 3*b* in a section plane in the printed matter transport direction, which is shown at 11*b* with a dash-and-dot line in FIG. 3*a*.

The resonator shown in FIGS. 3*a* and 3*b* is divided into two parts, an upper part 1 and a lower part 2, with a gap 3 defined between them, through which the printed matter is caused to move for heating.

Microwave energy is fed from the resonator from below through two holes 4 by two microwave sources at the same frequency or by a single microwave source. The single source may be is connected to both holes 4 and has it energy divided by a power splitter into two cavity areas 5 of the resonator, in which the cavity area located on the side of the gap 3 as seen from the microwave entry is divided, at least partly, with at least one partition wall portion 6 and runs in parallel with the printed matter transport direction. The partition wall portion 6 has, at least on one side, a protruding shelf 7 extending in parallel with the printed matter transport plane, which preferably defines a part of a free-passage shutter 9 in the shutter opening 8 at the microwave entry. The plane defined by the elements 9, 8, and 7 actually represents a part (sheet) having an opening (shutter), with the opening (shutter) that is held in place (clamped). The part under this plane belongs to the power splitter. The distance from the shelf 7 or shelf 7 and from the shutter 9 to an edge 10 of the partition wall portion 6 facing toward the gap 3 is shown at G, which can be preset or adjustable.

It should be noted that the end face of the resonator remote from the microwave entry side is closed with a cavity cover 11. As can be seen, the cover 11 has a recess 12 extending in parallel with the printed matter transport direction. The recess 12 is made as a groove in the cover 11, extending from one cavity wall 13 to the other. In reality, parts with dimensions I and J are attached to the resonator without making a cover with the recess. The depth J of the recess 12 is preset or adjustable, just as the width 1 of the border or borders of the recess 12, transversally of the printed matter transport direction.

The cavity area of the resonator part 1 located on the side opposite to the gap 3 as seen from the microwave entry has at least one flange protruding inwardly into the cavity. The flanges define a limiting surface portion for the gap, and/or, cavity area of the resonator part 1 located on the side of the gap 3 as seen from the microwave entry. The flanges have a dimension H, which is preset or adjustable.

Other dimensions A, B, C, D, and E shown in FIGS. 3*a* and 3*b* are as follows: A is a distance from the shutter 9 to the gap 3, B is the height of the gap 3, C is the distance from the gap 3 to the inner surface of the recess 12, D is the distance from the resonator centerline (dash-and-dot line 111*b*) to the inner surface of the cavity wall 13, and E is the inner dimension (length) of the resonator cavity.

With the above-mentioned dimensions, the preferred embodiment of the resonator according to the invention is made with the dimensions shown in Table 1.

TABLE 1

| | |
|---|---|
| A | 37 mm |
| B | 6 mm |
| C | 35 mm |
| D | 50 mm |
| E | 92 mm |
| G | 0–10 mm |
| H | 0–10 mm |
| I | 0–50 mm |
| J | 0–20 mm |

In this embodiment of the resonator according to the invention, the dimension G can be use to change the side steepness of the power distribution profile, and the dimensions I and J can be used to influence the curvature of the power profile in the middle area. This will be illustrated and explained in detail with reference to FIG. 4.

Figure 4:
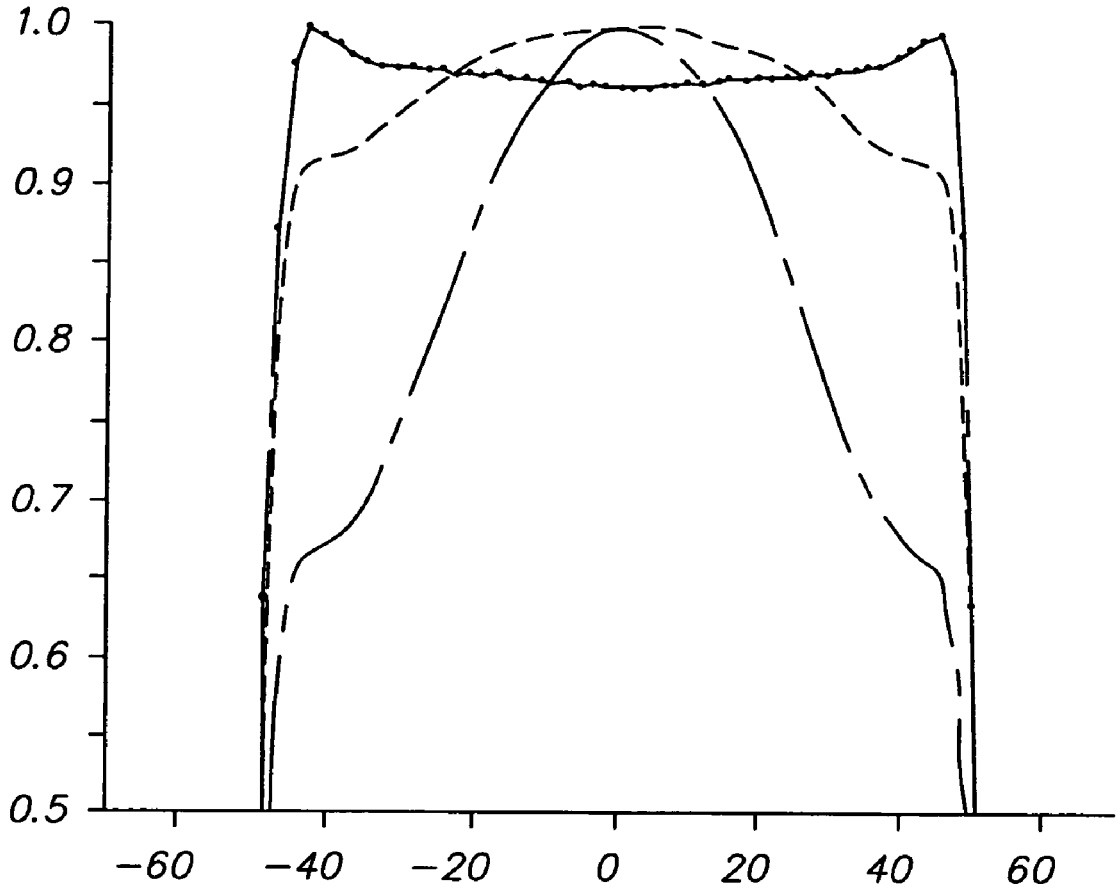
FIG. 4 shows an exemplary power distribution profile of the resonator shown in FIGS. 3*a* and 3*b* as a function of position, with the dimensions of the resonator according to Table 2.

FIG. 4 illustrates changes in the power distribution profile of the resonator shown in FIG. 3 as a function of position transversally with respect to the printed matter transport direction, also as seen in the direction of FIG. 3*a* to a chosen scale. There are a solid thick line, a dotted line, and a dash line. It can be seen in FIG. 4 that the side steepness remains almost the same when the side reaches a preset value. The curves differ by the curvatures of the sides. The curvature of the curve, change from very negative to slightly positive curvature.

The profile changes when the dimension 1 of the resonator shown in FIG. 3 changes as shown in Table 2.

TABLE 2

| Resonator dimensions (mm) | H | I | J | Line style |
|---|---|---|---|---|
| | 2 | 5 | 15 | Dotted |
| | 2 | 10 | 15 | Dash |
| | 2 | 25 | 15 | Solid line |

It is possible, in one way or the other, to use this in order to select or adjust an optimized profile in accordance with the current or desired process requirements or boundary conditions at the edges.

Figure 5:
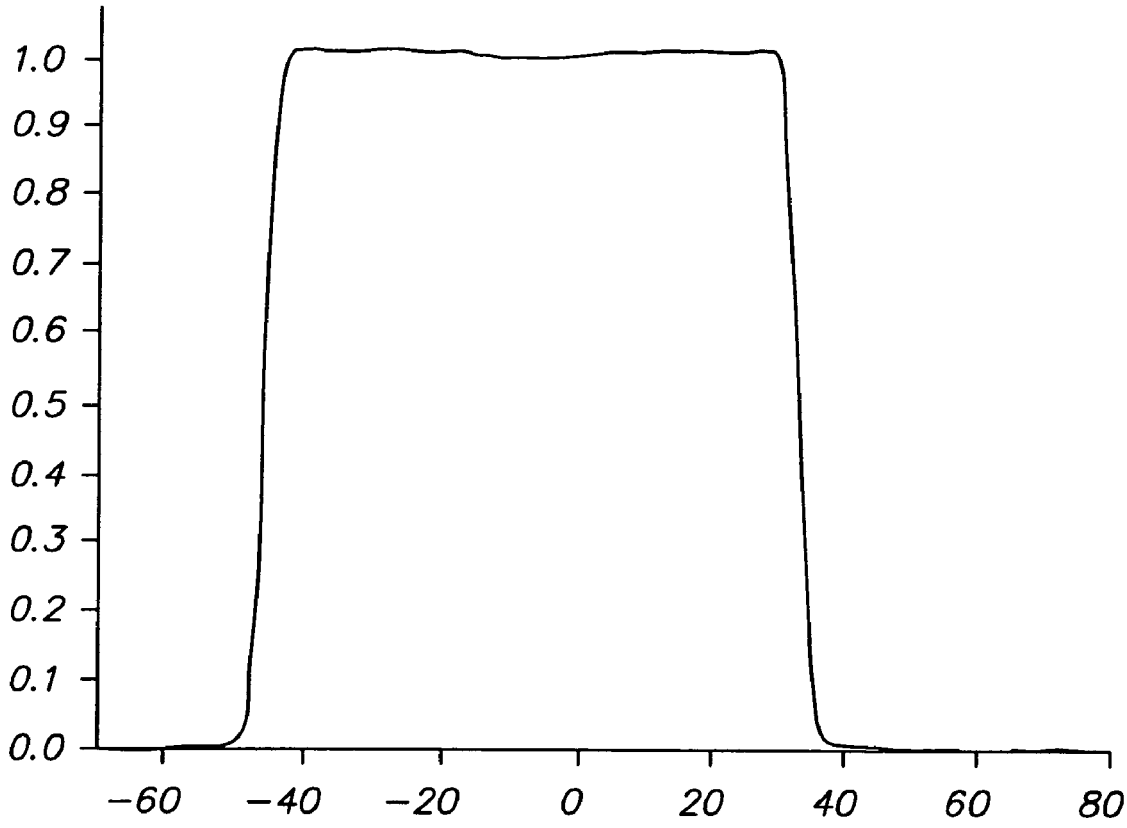
FIG. 5 is a power profile similar to that shown in FIG. 4 specifically for obtaining a profile that is as close to rectangular as possible, with the dimensions of the resonator per Table 3.

FIG. 5 shows, similarly to FIG. 4, an almost perfectly rectangular power distribution profile of the resonator of FIG. 3. This special case can be obtained by using the dimensions of the resonator per Table 3 given below.

TABLE 3

| | |
|---|---|
| A | 37 mm |
| B | 6 mm |
| C | 35 mm |
| D | 50 mm |
| E | 92 mm |
| F | 0.1 mm |
| G | 10 mm |
| H | 2 mm |
| I | 6 mm |
| J | 17 mm |

Figure 6:
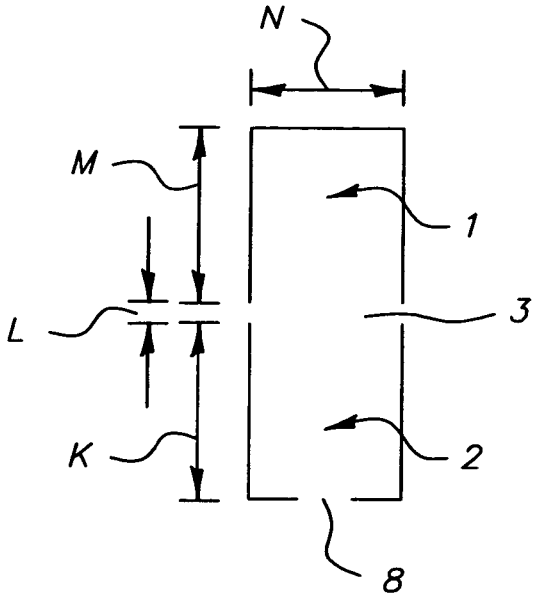
FIG. 6 is a schematic sectional view of a simple cavity of a resonator having dimensions shown in Table 4, given to explain and illustrate the result of a change in the width and height of the gap dividing the resonator, jointly with FIG. 7.
Figure 7:
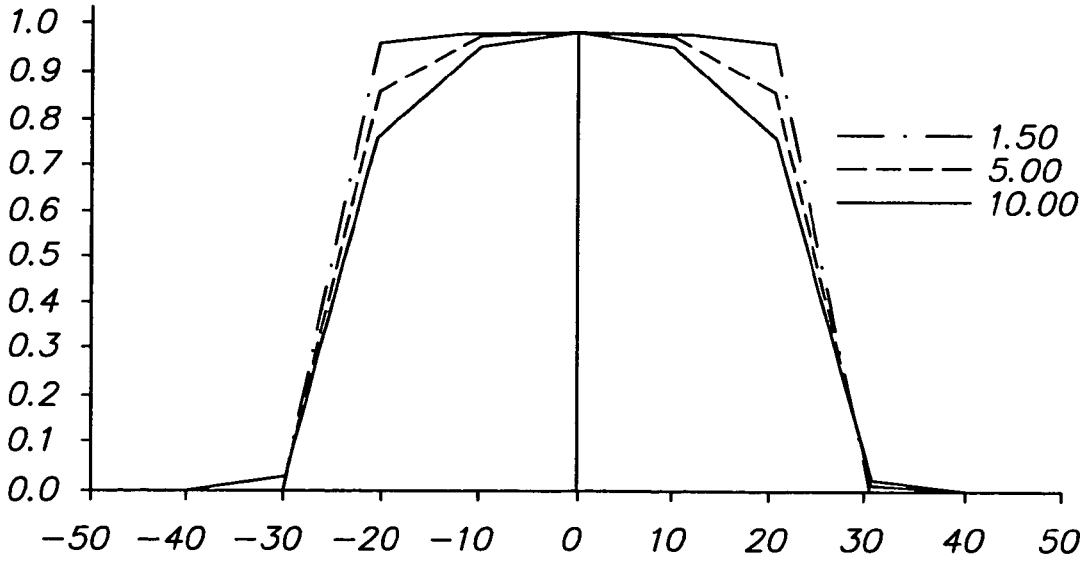
FIG. 7 is an exemplary power distribution profile as a function of position when the gap width of the resonators of FIG. 6 is changed.

A principle additional or alternative additional mechanism for influencing the power distribution profile of the resonator according to the invention is shown in FIGS. 6 and 7. FIG. 6 shows schematically a partial sectional view of a simple cavity resonator as seen in the same direction as in FIG. 3*a*. The resonator shown in FIG. 6 also consists of two parts 1 and 2, which are divided by the gap 3 for movement of the printed matter. A microwave source can connect from below at the shutter opening 8.

As shown in FIG. 6, N is the width of the resonator transversally of the printed matter transport direction, M is the height of the part 1, K is the height of part 2, and L is the gap height. The power distribution profile of the resonator can be then influenced by varying the gap height L. When the dimensions K, L, M, and N are chosen or changed, e.g., per Table 4, the variations of the profile as shown in FIG. 7, which is similar to FIGS. 4 and 5, can be obtained.

TABLE 4

| | |
|---|---|
| K | 37 mm |
| L | 1–10 mm |

TABLE 4-continued

| | |
|---|---|
| M | 35 mm |
| N | 52 mm |

FIG. 7 shows the profile with a dash-and-dot line, a dotted line, and a solid line for the gap height and width L that equals 10 mm, 5 mm, or 1.5 mm and for the remaining dimensions from Table 4.

As can be seen, the power distribution profile becomes more rounded with an increase in the gap width L. This can be preferably used to adjust the desired profile, taking into account the boundary conditions at the edges such as accuracy of the printed matter path and cooling. Higher leak radiation, which occurs because of wider gap 3, can be compensated for by a predetermined filter structure for each gap width. For two end resonators of the resonator set, this filter structure can be provided if the gap 3 is laterally closed with a metal plate.

In the analysis of the gap width, the power distribution profile can be of an asymmetric shape. The gap width can be, for example, continually varying in the direction at right angles to the printed matter transport direction, whereby the profile on the side where the gap is wider will be flatter than the profile on the side where the gap width is smaller. This can be also pushed further, and the end resonator in the printed matter path can be completely closed on the outer side, which is advantageous both for lower emission outside and for a steeper profile rise on the closed side.

Other options are that the profile sides can be influenced with the resonator according to the invention:

Twisting the applicator in the paper plane. The electric field profile of the resonator in the process direction is almost sinusoidal. Therefore, the heating profile of the resonator will become even flatter when twisting on the side with the rectangular profile.

Arranging two resonators with different widths one behind the other in order to have two different heating areas.

Introducing of a movable non-absorbing dielectric load (e.g., of PTFE [polytetrafluoroethylene]). This load results in changing the field distribution in its immediate vicinity. If this load is provided adjacent to the gap 3, the field profile can be changed.

The resonator width is the important size aspect. If printed matter of a predetermined maximum width is fed for fixing, the width of each resonator can be freely chosen subject to considerations of the boundary conditions.

The boundary conditions are as follows:

1. Printed matter width
2. Quantity of resonators
3. Overlap zones width

It can be seen that the position of the resonators along and transversally of the printed matter transport direction does not have any importance.

Figure 8:
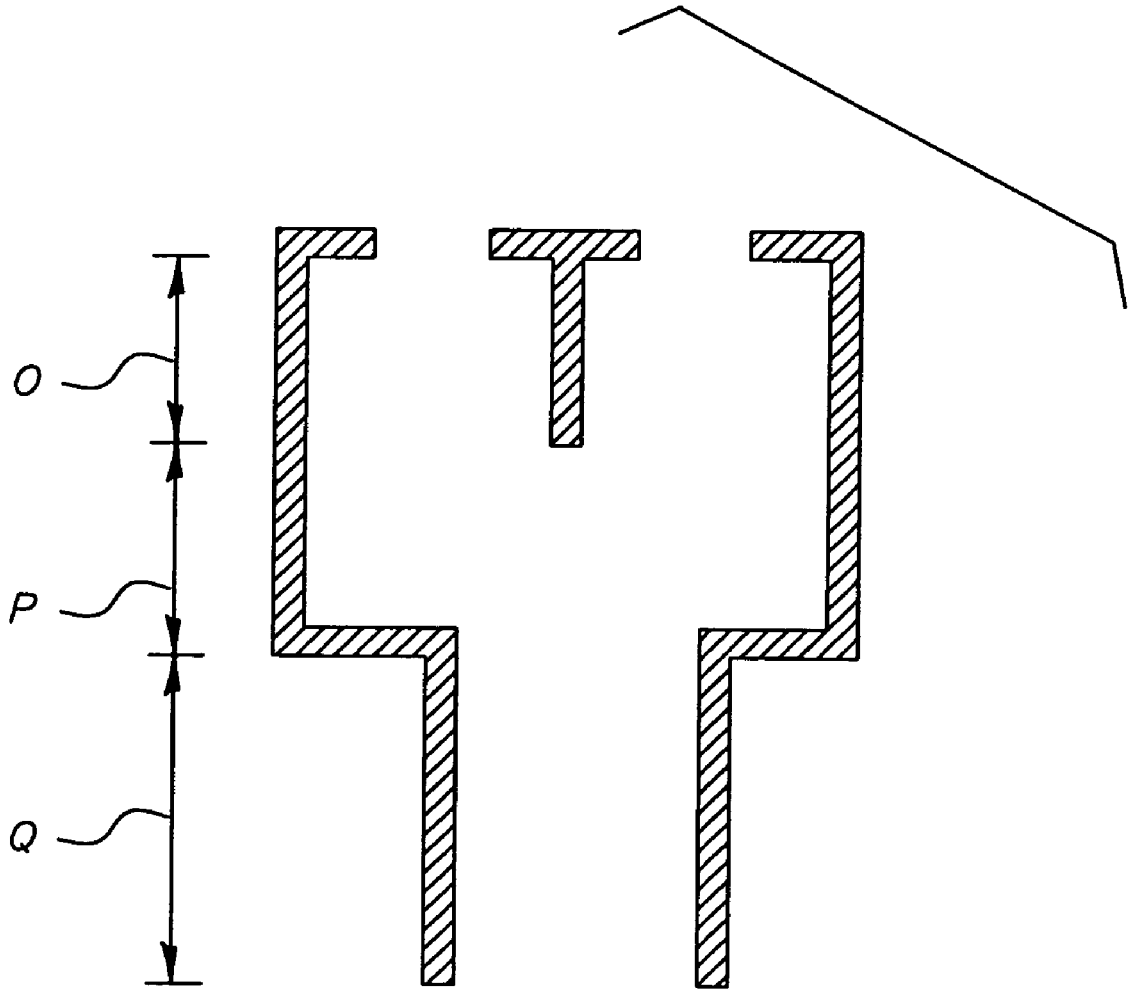
FIG. 8 is a sectional view taken through a power splitter in the same plane as the resonator sectional view in FIG. 3*a;*

In coupling a plurality of TE-101 elements together, it is important that the frequency of microwave emitted by the resonators be the same. The best solution is to emit microwave power through a so-called power splitter. A power splitter for resonators shown in FIG. 3*a* is shown in FIG. 8, in which the power splitter is provided under the openings. The microwave source proper will be provided under the power splitter.

The dimensions of the power splitter O, P, and Q in the vertical elevation view of the power splitter are chosen per Table 5 given below.

TABLE 5

| | |
|---|---|
| O | 30 mm |
| P | 30 mm |
| Q | 30 mm |

It will be apparent that the dimensions can vary.

In a simple resonator, e.g., per FIG. 6, the maximum width N is limited by the TE-101-Mode. With a greater width, other modes can occur, and the heating profile will not be maintained and can become unacceptable. If the width changes, other structural measures should be taken in order to maintain the TE-101-Mode of the resonator.

Figure 9:
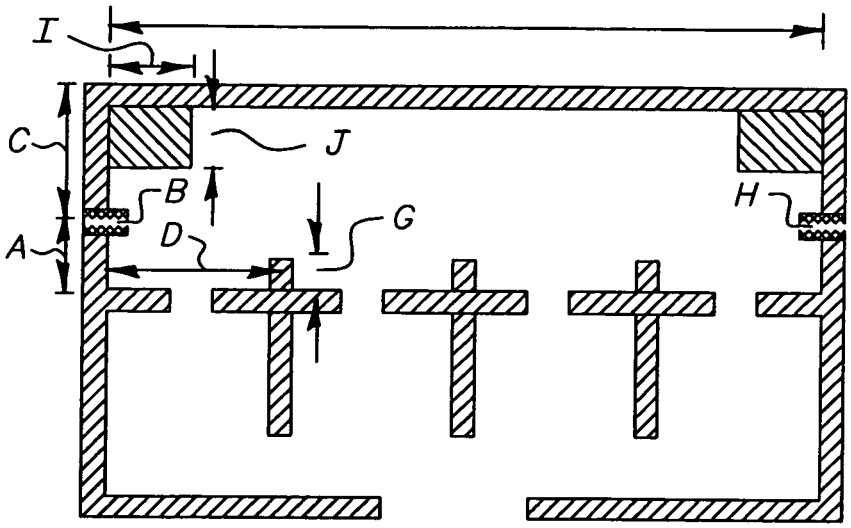
FIG. 9 is a sectional view of the resonator with a broader interaction zone.

An embodiment with a larger width is possible according to FIG. 3*a*. For this purpose, two cavity areas 5 of the TE-101 resonators are coupled over a large opening above the partition wall 6 in the middle. The width D of each resonator has a characteristic parameter. An embodiment for a larger width of the cavity area of TE-101 resonators is shown in FIG. 9. It can be seen that there are four areas of a width D, which are interconnected. With an appropriate choice of dimensions, the power distribution profile similar to that described above can be obtained.

Figure 10:
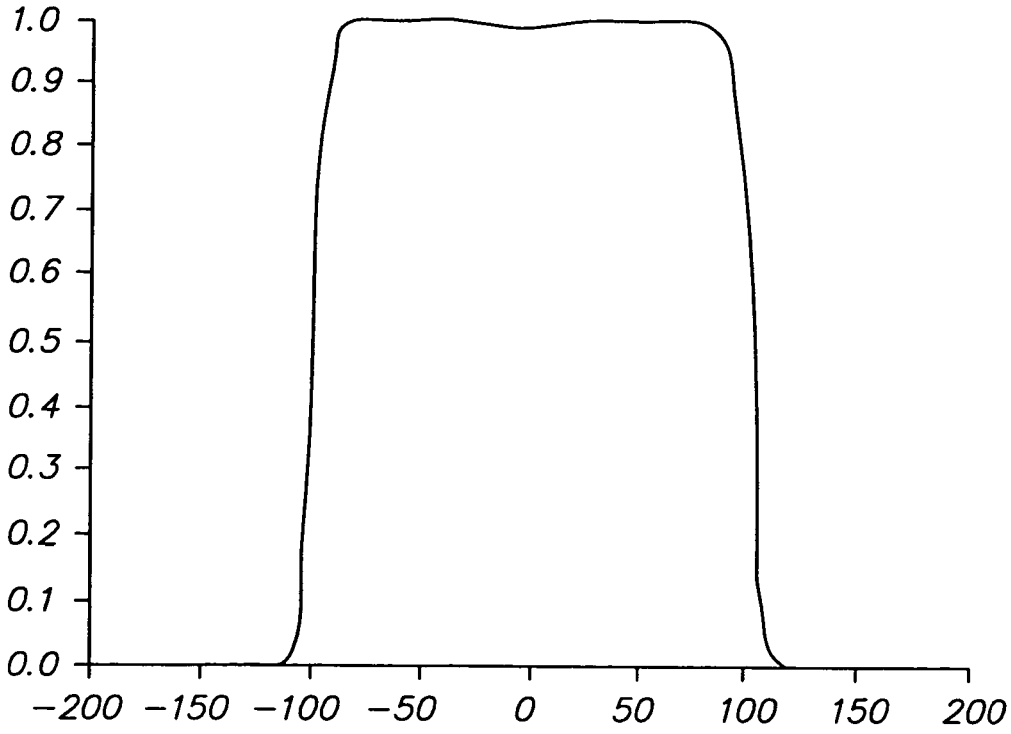
FIG. 10 is an exemplary power distribution profile as a function of position.

FIG. 10 shows an example of power distribution, which can be obtained with the following dimensions given in Table 6:

TABLE 6

| | |
|---|---|
| A | 35 mm |
| B | 15 mm |
| C | 33 mm |
| D | 49.5 mm |
| E | 92 mm |
| G | 6 mm |
| H | 4.5 mm |
| I | 6 mm |
| J | 17 mm |

Figure 11:
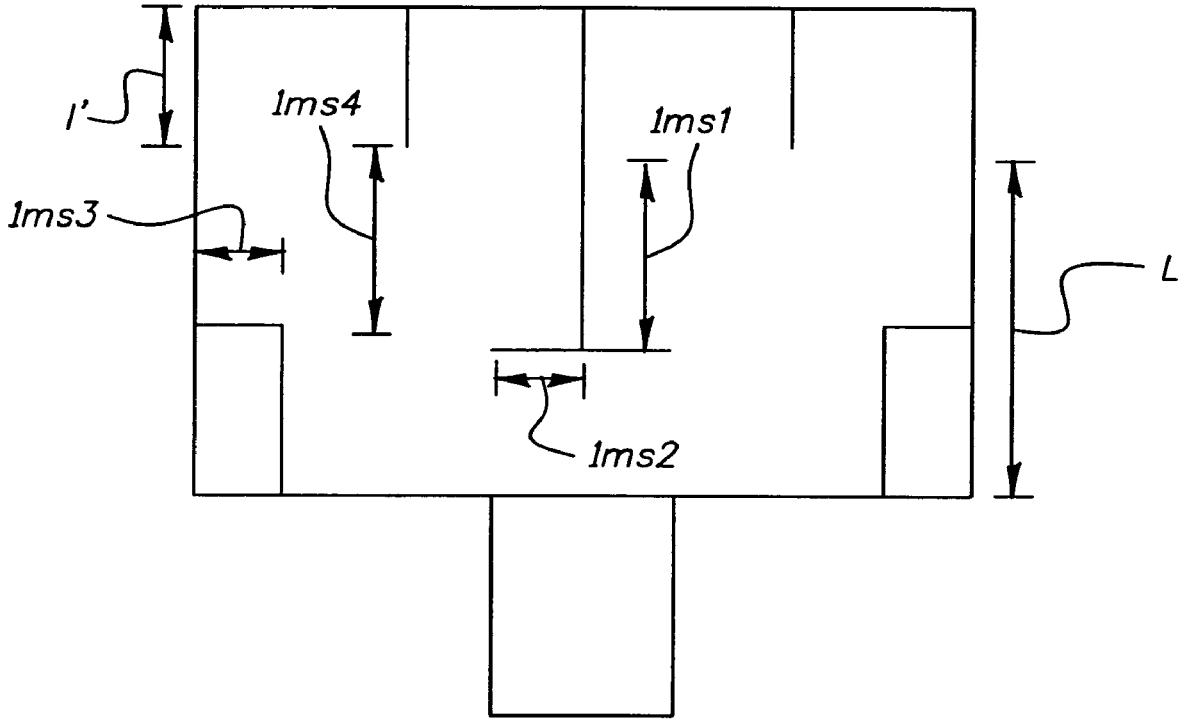
FIG. 11 is a power splitter optimized for wider resonators.

If a single microwave source is used as a power source, the power splitter can be also adjusted in addition to optimization of dimensioning so as to assure the same power at each shutter opening. A power splitter for the resonators shown in FIG. 9 is presented in FIG. 11 as an example. This power splitter has the dimensions given in Table 7:

TABLE 7

| | |
|---|---|
| L | 58 mm |
| I' | 28 mm |
| Lms1 | 28.8 mm |
| Lms2 | 35 mm |
| Lms3 | 32.5 mm |
| Lms4 | 25 mm |

It is further possible to achieve a larger width by adding more resonators of a width D, coupling, and combining them to a larger opening. In principle, the width in the transport direction should be varied rather than kept constant, so it can vary thus improving the heating profile.

With a plurality of resonators, the width of different resonators can be chosen differently. A good set can be obtained if the side edges of the printed matter are always transported through the resonators even when the position of the side edges varies in the event that the printed matter of different size is treated.

Based on the process technique considerations, it may be advantageous if the resonator length can be changed in the transport direction. On the one hand, this allows for reducing the overall size of the apparatus, and one the other hand, the apparatus can be extended in order to increase the length of the fusing and fixing interaction. When the resonator length (E) is changed, the resonator height should be changed based on the electrical boundary conditions (A+B+C). This relationship is known in principle, and it is expressed by the following equation for TE-101 resonator:

$$f_r = \frac{1}{2\pi\sqrt{\mu_0\varepsilon_0}}\sqrt{\left(\frac{\pi}{E}\right)^2 + \left(\frac{\pi}{A+B+C}\right)^2}$$

(wherein $\mu_0$ and $\epsilon_0$ are the induction constant and influence constant, and $\pi$ is the quantity of circuits). The value of $f_r$ should be kept constant when the change is made. Therefore, when the length (E) is changed, the height (A+B+C) is changed automatically. The useful values of the parameter E range from 30 mm to 200 mm, preferably from 60 mm to 100 mm.

The invention has been described in detail with particular reference to certain preferred embodiments thereof, but it will be understood that variations and modifications can be effected within the spirit and scope of the invention.

What is claimed is:

1. An apparatus for heating a printing substance and/or toner, in an electrophotographic printer, having at least one resonator with at least one cavity for microwaves emitted by a microwave transmitter, microwave source, or microwave generator, which produces at least one standing microwave, and which has a gap through which printed matter is caused to move, said apparatus comprising: said resonator configured for power distribution of the resonator-applied microwave which is preset and adjusted for each application requirement, said power distribution as a function of position is divided substantially into three areas, two areas from the walls of the resonator to the middle, in which the power remains constant, and the area between them, which represents a curve having a curvature such that the power distribution is trapezoidal, and by the fact that the side steepness is adjusted or changed.

2. The apparatus of claim 1, wherein the power distribution as a function of position has a substantially trapezoidal profile curvature of the middle base area of the trapezium which is adjusted or changed to have a positive (convex) shape, a negative (concave) shape, or no curvature (flattening).

3. The apparatus of claim 2, wherein the power distribution profile is shaped as a rectangle (U-shaped).

4. The apparatus of claim 1, wherein the power distribution profile as a function of position is asymmetrical with respect to the centerline.

5. The apparatus of claim 1, wherein the power distribution varies in time.

6. The apparatus of claim 1, wherein the width of the resonator gap is adjusted or changed.

7. The apparatus of claim 6, wherein the end face of the resonator remote from the microwave entry side is closed with a cavity cover, which has a recess extending in a direction parallel with the printed matter transport direction.

8. The apparatus of claim 7, wherein the recess is made as a groove in the cavity cover and extends from one wall of the cavity to the other.

9. The apparatus of claim 8, wherein the depth of the recess is adjustable.

10. The apparatus of claim 9, wherein the width of a border of the recess, transversally with respect to the printed matter transport direction, is adjustable.

11. The apparatus of claim 1, wherein the cavity area located on the side of the gap as seen from the microwave entry has at least one flange protruding inwardly in the cavity, which is used as a limiting surface portion for the gap.

12. The apparatus of claim 11, wherein the width of the at least one flange edge, transversally with respect to the printed matter transport direction, is adjustable.

13. The apparatus of claim 12, wherein the cavity area located on the side of the gap as seen from the microwave entry has at least one partition wall portion partly dividing the cavity area, which runs in parallel with the printed matter transport direction.

14. The apparatus of claim 13, wherein separate microwave sources are connected to each cavity area.

15. The apparatus of claim 13, wherein a common microwave source is connected to the cavity areas, which is used to supply the cavity areas via a power splitter.

16. The apparatus of claim 13, wherein the partition wall portion has, at least on one side, a shutter extending in parallel with the plane of printed matter transport through the gap.

17. The apparatus of claim 16, wherein the distance from the shutter to the edge of the partition wall portion facing the gap is adjustable.

* * * * *